United States Patent [19]

Hole

[11] Patent Number: 4,561,651

[45] Date of Patent: Dec. 31, 1985

[54] WEIGHT LIFTING MACHINE

[76] Inventor: Robert W. Hole, 4785 Young St., Willowdale, Ontario, Canada, M2N 5M5

[21] Appl. No.: 494,871

[22] Filed: May 16, 1983

[51] Int. Cl.[4] ..... A63B 21/06

[52] U.S. Cl. ..... 272/117; 272/123; 272/134; 272/DIG. 4; 272/118

[58] Field of Search ..... 272/117, 118, 122, 123, 272/93, 134, 143, DIG. 4

[56] References Cited

U.S. PATENT DOCUMENTS

| | | | |
|---|---|---|---|
| 3,116,062 | 12/1963 | Zinkin | 272/118 |
| 3,752,473 | 8/1973 | La Lanne | 272/118 X |
| 3,905,599 | 9/1975 | Mazman | 272/118 |
| 3,917,262 | 11/1975 | Salkeld | 272/118 |
| 4,153,244 | 5/1979 | Tauber | 272/117 |
| 4,252,314 | 2/1981 | Ceppo | 272/117 |
| 4,324,398 | 4/1982 | Hole | 272/123 |

OTHER PUBLICATIONS

"Dyna Cam"—Dynamics Manufacturing Co., Inc.

"Marcy Circuit Trainer—Marcy Institutional Catalogue pp. 9,10.

*Primary Examiner*—Richard J. Apley

*Assistant Examiner*—William R. Browne

*Attorney, Agent, or Firm*—Fetherstonhaugh & Co.

[57] ABSTRACT

A weight lifting machine is provided with a readily adjustable stop bar for use in arresting the lowering of weights in use. The adjustment mechanism includes manually adjustable latches mounted at each end of the stop bar for engagement with passages formed in the upright frame members of the machine. These latches can be manually engaged by an operator standing in the weight lifting station and suitable slides are provided which cooperate between the stop bar and the upright members to maintain transverse alignment of the stop bar as it is moved vertically with respect to the upright members.

1 Claim, 4 Drawing Figures

WEIGHT LIFTING MACHINE

This invention relates to weight lifting machines. In particular, this invention relates to improvements in weight lifting machines which include the provision of a weight arresting bar, a detachable weight pulling assembly, a detachable chinning bar and means for releasably securing a bench to the weight lifting frame.

BACKGROUND OF THE INVENTION

In my prior U.S. Pat. No. 4,324,398 dated April 13, 1982, there is disclosed a weight lifting apparatus which includes an upright frame and a weight arresting bar which is vertically adjustable with respect to the frame.

OBJECTS OF THE INVENTION

One object of the present invention is to simplifying the mounting of the weight arresting bar such that it can be adjusted as to height by each individual user while automatically retaining a horizontal configuration. In my prior structure, it was necessary to remove locking pins and to withdraw the mounting pins from the passages which were formed in the upright beams and then it was necessary to relocate the arresting bar and reposition the mounting pins and locking pins. This mechanism was such that individual weight lifters tended to avoid making the appropriate adjustments and by so doing, did not take full advantage of the safety aspects of my prior apparatus.

It is an object of the present invention to provide a simple and efficient mechanism which permits vertical adjustment of the weight arresting bar by each weight lifter as required in use.

SUMMARY

My weight lifting apparatus is such that it is frequently desirable to use a bench in association with it for performing foot press exercises. In order to prevent movement of the bench with respect to my weight lifting apparatus, I provide that the bench may be releasably attached to the main frame of the weight lifting apparatus. This increases the safety with which bench exercises may be carried out.

To further increase the versatility of my weight lifting machine, I provide a weight pulling subframe which may be releasably attached to the upper end of the main frame.

To provide yet another extended use, I provide a chinning bar which may be releasably secured to the main frame in a position extending transversely above the weight lifting station.

According to one aspect of the present invention, there is provided a weight lifting machine having a frame which includes a pair of upright members and a stop bar mounted on the upright members through which weight retaining cables extend and against which a weight arresting stop carried by the cables is arranged to bear to limit the extent to which the weight suspended from the cables may be lowered, the improvement wherein, each of said upright members has an inner face and a back face, said inner face is being disposed opposite one another, a plurality of mounting passages formed in said upright members and extending laterally therethrough from said inner faces, said passages being vertically spaced from one another and extending over a predetermined length of each upright member, a guide rail mounted on each back face of said upright members and extending vertically thereof over at least a major portion of said predetermined length, a slide member mounted on opposite ends of said stop bar and slidably engaging said guide rail to retain said stop bar against lateral movement while permitting longitudinal movement of said stop bar with respect to said upright members, a mounting bracket mounted at each end of the stop bar laterally inwardly from the slide members, said mounting bracket extending forwardly from the stop bar to overlie the inner face of the adjacent upright, a latch mounted on and retained in each mounting bracket, each latch comprising a pair of latch pins slidably mounted in its associated mounting bracket and vertically spaced so as to be movable relative to said mounting bracket between a retracted position in which the latch pins are withdrawn from the mounting passages and an extended position in which the latch pins extend into said mounting passages to retain said stop bar against vertical movement along said slide rail, spring means normally urging said latch pins to the extended position, said latch members being manually engageable for movement between said extended and retracted positions and said stop bar being longitudinally movable with respect to said longitudinal members when said latch pins are in said retracted positions.

According to a further aspect of the present invention, there is provided a weight lifting machine comprising, a main frame having a pair of base members arranged one on either side of mounting station and an upright portion projecting upwardly from the base members, a foot press mechanism mounted on said main frame, said foot press mechanism having a foot press plate projecting forwardly from the upright portion, a bench comprising a bench frame and a seat at a first end of the bench frame, said bench having a base portion underlying the seat,d) anchor means releasably securing said base portion of said bench frame to each of said base members of said main frame to retain said bench against movement with respect to said main frame during foot press exercise use thereof.

According to yet another aspect of the present invention there is provided in a multi-purpose weight lifting machine having a main frame which includes a pair of overhead beams mounted one on either side of a weight lifting station and extending longitudinally thereof, said overhead beam having a back end spaced rearwardly from and a front end disposed above said weight lifting station, the improvement of a detachable pulley assembly and support means on the main frame for supporting said assembly, said detachable pulley assembly comprising; a longitudinal beam member having a front end and a back end, a transverse beam member mounted on said longitudinal beam member and extending transversely of the front end thereof, said transverse beam being adapted to reseasably secured to said main frame to locate the front end of the longitudinal beam directly above said weight lifting station, pulley means on said longitudinal beam member, and, a cable extending over said pulleys and having one end depending from the back end of the longitudinal beam for connection to weights mounted on the main frame and one end depending from the front end of the main frame into said station so as to be engageable for a weight lifting exercise as required in use.

According to a still further embodiment of the present invention there is provided in a multi-purpose weight lifting machine having a main frame which includes a pair of overhead beams mounted one on either side of a weight lifting station and extending longitudinally thereof, said overhead beam having a back end spaced rearwardly from and a front end disposed above said weight lifting station, the improvement of a chinning bar comprising a transverse member having a sufficient length to bridge the front ends of said overhead beams and means for releasably securing said transverse beam member to said front end of said overhead beams whereby said transverse beam extends transversely above said weight lifting station for use as a chinning bar.

DESCRIPTION OF THE PREFERRED EMBODIMENTS

Figure 1:
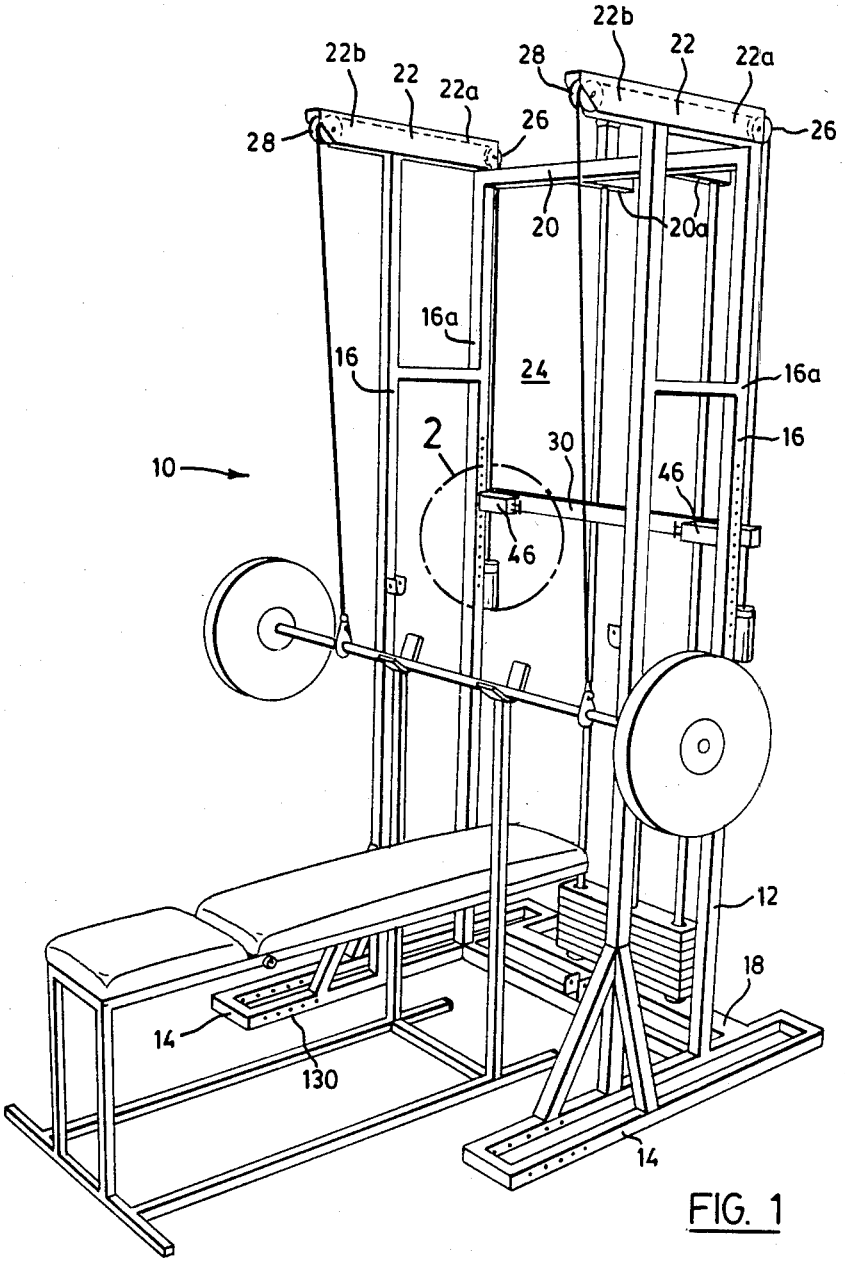
FIG. 1 is a pictorial front view of my weight lifting mechanism and a bench for use therewith.

With reference to FIG. 1 of the drawings, the reference numeral 10 refers generally to a weight lifting machine constructed in accordance with an embodiment of the present invention. The weight lifting machine 10 comprises a frame 12 which consists of a pair of base members 14, a pair of upright members 16, a lower transverse member 18, an upper transverse member 20 and a pair of longitudinally extending beam members 22. The longitudinally extending beam members 22 are arranged one at either side of and above the weight lifting station generally identified by the reference numeral 24. The beam members 22 have a back end 22A and a front end 22B. Pulleys 26 and 28 are rotatably mounted at the back and at the front ends respectively of the beams 22.

Figure 2:
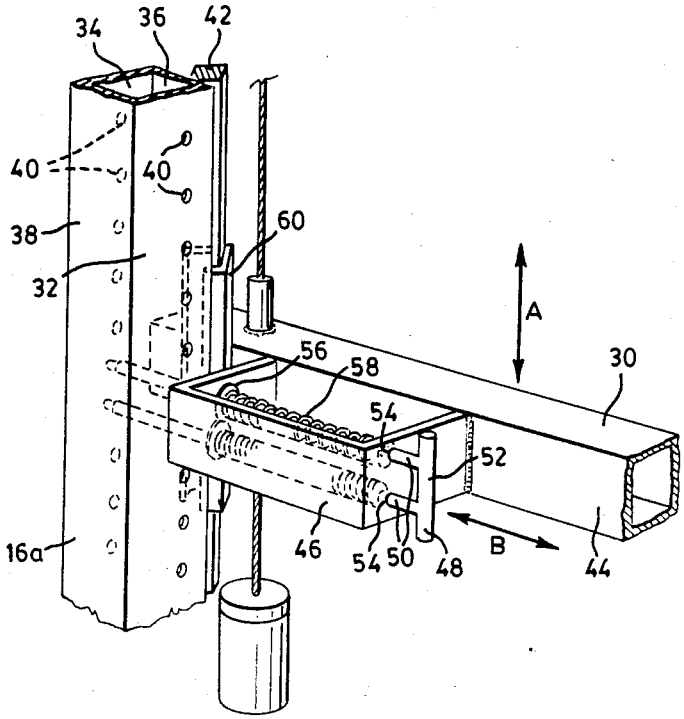
FIG. 2 is an enlarged detailed view of the latching mechanism of the weight arresting bar of FIG. 1.

Each of the upright frame members 16 has a back column 16A upon which the weight arresting bar 30 is adjustably mounted as will now be described with reference to FIG. 2 of the drawings. As shown in FIG. 2 of the drawings, the column 16A is the in the form of a square sectioned post which has an inner wall 32, an outer wall 34, a back wall 36 and a front wall 38. A plurality of passages 40 extend through the inner walls 32 and 34 at vertically spaced intervals. A diamond shaped guide rail 42 is mounted on the back wall 36 and extends longitudinally of the column 16A over the sufficient length to provide support for movement of the weight arresting bar 30.

The weight arresting bar 30 is in the form of a square tubular member which has an inner face 44 upon which a pair of U-shaped brackets 46 are mounted inwardly from opposite ends thereof. A latch 48 is mounted on each bracket 46. The latch 48 comprises a pair of latch pins 50 which are connected at their inner ends by means of a crossbar 52. The latch pins 50 extend through passages 54 formed in the bracket 46. The pins 50 have retaining washers 56 mounted thereon between and a coil spring 58 is mounted on each pin 50 so as to be compressed between the mounting washer 56 and the opposite end of the bracket 46 when the pins are withdrawn from the passages 48. The coil springs 58 normally urge the latch to the position in which the latching pins project outwardly from the bracket 46 for insertion into the passages 40.

A slide member 60 is mounted on the beam 30 and slidably mounted on the rail 42. The slide member 60 has a profile which engages the diamond shaped profile of the guide rail 42 so as to limit the movement of the bar 30 to vertical movement in the direction of the arrows A.

To adjust the height of the weight arresting bar 30, the crossbars 52 of the latch assemblies 48 are manually engaged and pulled inwardly in the inward direction of the arrows B to withdraw latching pins from the passages 40 and then the bar is adjusted to the required height and the latching pins are relocated by inserting them into the passages 40 so that they extend therethrough. From the foregoing, it will be apparent that the adjustment of the weight arresting bar 30 can now be achieved by manipulating the latching mechanisms without requiring a skilled operator. Furthermore, the provision of the longitudinally elongated guide rail and slide member serves to maintain the crossbar 30 in a horizontal configuration thus insuring horizontal transverse alignment of the weight arresting bar in all its vertical positions.

Figure 3:
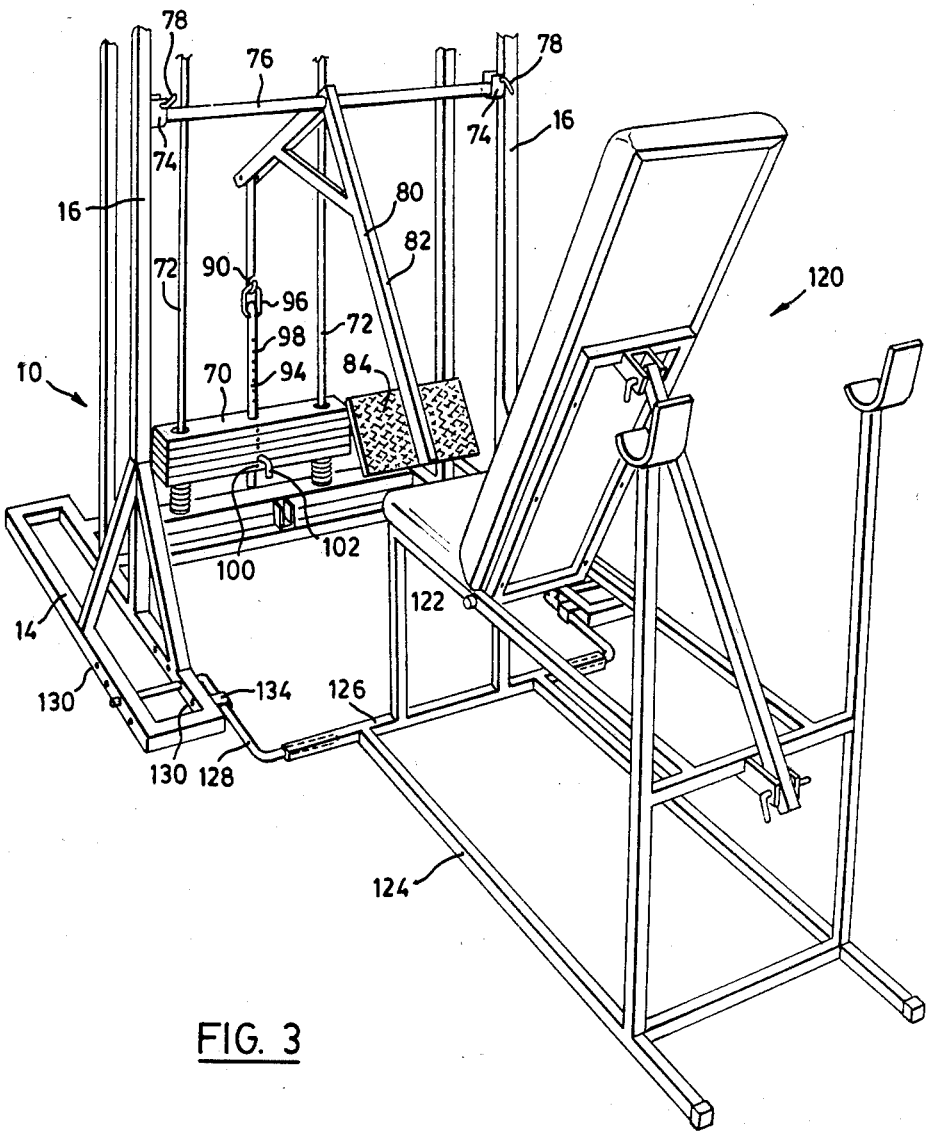
FIG. 3 is a pictorial view of the lower portion of my weight lifting machine arranged to cooperate with a bench for foot press exercises.

A further feature of the present invention is illustrated in FIG. 3 of the drawings wherein it will be seen that a plurality of weights 70 are slidably mounted on guide rods 72 which extend from the transverse frame member 18 to arms 20A which project rearwardly from the upper transverse frame member 20. A pair of U-shaped stirrups 74 are mounted on uprights 16. A shaft 76 is releasably mounted in the stirrups 74 and retained therein by removable pins 78. A bell crank lever 80 is mounted on the shaft 76 centrally of the width thereof and has one arm 82 which has a foot pedal 84 located at its outer end. The other arm 86 of the lever 80 is connected to a support post 88 which has a hook shaped end 90. The weights 70 are mounted on a support post 94 which has an eye 96 at its upper end adapted to releasably engage the hook shaped end 90 of the support 88. A plurality of mounting passages 98 extend through the support 94 and a passage 100 is formed in each of the weights 70 which is alignable with the passages 98 in the support column 94. A pin 102 may be arranged to extend through any one of the weights 70 to selectively secure any number of weights with respect to the support column 94 for movement therewith.

A bench generally identified by the reference numeral 120 is formed with a seat portion 122 at the front end of the frame 124. The frame 124 has a transverse bar 126 located at the front end thereof underlying the seat 122. A Z-shaped connecting bar 128 serves to connect each base member 14 of the frame 10 to the transverse bar 126 of the frame 124 of the seat. A plurality of passages 130 are formed at spaced intervals along the inner edge of each base member 14 to permit the position of the seat 122 to be laterally adjusted with respect to the foot pedal 84 as required in use. To prevent the front end of the bench lifting from the floor during foot press exercises, a bracket 134 extends outwardly from the inner face of the base member 14 to receive the connecting bar 128.

It will be apparent that the forces tending to lift the front end of the bench will be transmitted to the main frame of the weight lifting machine and will be resisted thereby.

Figure 4:
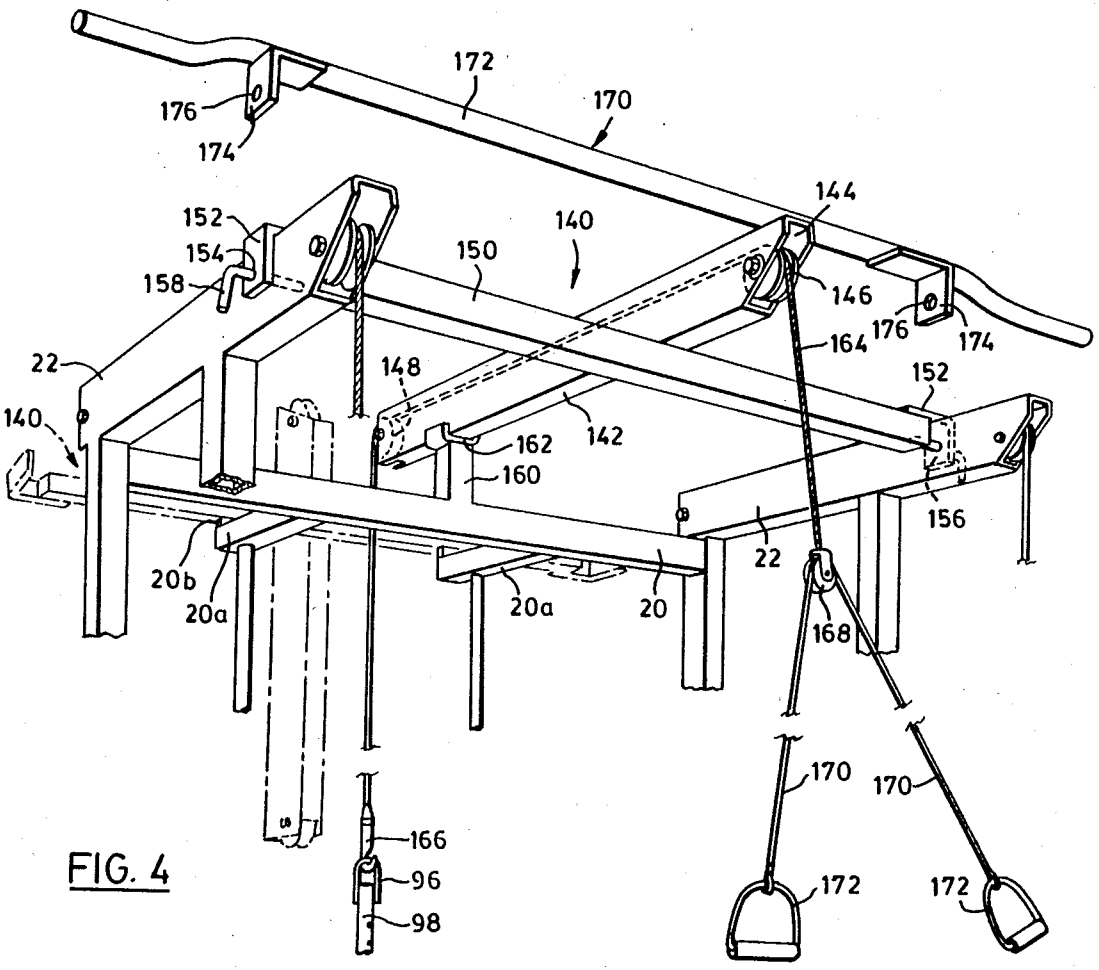
FIG. 4 is a partially exploded view of the upper end of my weight lifting mechanism illustrating the detachable pulley assembly and detachable chinning bar.

A releasable attachment which permits the weight lifting machine of the present invention to be used for pull down exercises, is illustrated in FIG. 4 of the drawings. This apparatus comprises a detachable pulley assembly generally identified by the reference numeral 140. This assembly comprises a longitudinal beam member 142 which has a hollow interior passage 144 which opens at opposite ends thereof. Pulleys 146 and 148 are mounted at the front and back ends respectively of the longitudinal beam member 142. A transverse beam member 150 is secured as by welding to the longitudinal beam member 142. A transverse beam member 150 has L-shaped brackets 152 at opposite ends thereof, each of which is formed with a passage 154 which opens therethrough in alignment with the open ends of the transverse beam member 150. The outer ends of the brackets 152 are spaced from the ends of the beam 150 a sufficient distance to permit the longitudinal beam members 22 to fit therebetween. Passages 156 are formed in the longitudinal beam members 22 through which pins 158 extend to releasably secure the transverse beam with respect to the longitudinal beam members 22 of the main frame. A post 160 projects upwardly from the transverse beam 20 of the main frame and has a U-shaped saddle 162 in which the back end of the longitudinal beam member 142 rests in use.

A cable 164 extends around pulleys 146 and 148 and has a hook 166 at one end thereof which may be releasably secured to the eye 96 of the weight support column 98. A further pulley 168 is located at the other end of the cable 146 around which a hand cable 170 extends. Handles 172 being secured at opposite ends of the hand cable 170 for use in pull down exercises.

When the detachable pulley assembly 140 is not required, it is removed by withdrawing the mounting pins 158 and is located in the position shown in broken lines in FIG. 4 wherein it depends from the arms 20A and is retained by lugs 20B which project upwardly from the back ends of the arms 20A. This provides a convenient storage location for the detachable pulley assembly 140.

A chinning bar 170 comprises a transverse beam 172 which has brackets 174 mounted at opposite ends thereof. Each bracket 174 has a passage 176 opening therethrough. The brackets 174 and passages 176 are arranged to assume the same position as the brackets 152 and passages 154 of the detachable pulley assembly previously described so as to be secured by means of pins 158 in a position bridging the front ends of the beams 22 to permit chinning exercises to be carried out from the weight lifting station.

From the foregoing, it will be apparent that the weight lifting machine of the present invention is a multi-purpose machine which is readily adaptable to facilitate the performance of a number of different exercises. These and other advantages of the apparatus of the present invention will be apparent to those skilled in the art.

Various aspects of the present invention will be apparent to those skilled in the art. For example, the diamond-shaped guide rails may be replaced by rails having a generally circular configuration.

I claim:

1. In a weight lifting machine having a frame which includes a pair of upright members and a stop bar mounted on the upright members through which weight retaining cables extend, and against which a weight arresting stop, which is carried by the weight retaining cables, is arranged to bear to limit the extent to which the weight, which is suspended from the cables may be lowered, the improvement wherein;

(a) each of said upright members has an inner face and a back face, said inner face is being disposed opposite one another, (b) a plurality of mounting passages formed in said upright members and extending laterally therethrough from said inner faces, said passages being vertically spaced from one another and extending over a predetermined length of each upright member, (c) a guide rail mounted on each back face of said upright members and extending vertically thereof over at least a major portion of said predetermined length, (d) a slide member mounted on opposite ends of said stop bar and slidably engaging said guide rail to retain said stop bar against lateral movement while permitting vertical movement of said stop bar with respect to said upright members, (e) a mounting bracket mounted at each end of said stop bar laterally inwardly from the slide members, each said mounting bracket extending forwardly from the stop bar to overlie the inner face of the adjacent upright, (f) a latch mounted on and retained in each mounting bracket, each latch comprising a pair of latch pins slidably mounted in its associated mounting bracket, said pins being vertically aligned and being movable relative to said mounting bracket between a retracted position in which the latch pins are withdrawn from the mounting passages and an extended position in which the latch pins extend into said mounting passages to retain said stop bar against vertical movement along said guide rail, spring means normally urging said latch pins to an extended position, said latch pins being manually engageable to move said to a retracted position, and said stop bar being vertically movable with respect to said upright members when said latch pins are in said retracted position.

* * * * *